United States Patent [19]

Perkins

[11] Patent Number: 4,830,110

[45] Date of Patent: May 16, 1989

[54] METHOD FOR COMPLETING WELLS IN UNCONSOLIDATED FORMATIONS

[75] Inventor: Thomas K. Perkins, Dallas, Tex.

[73] Assignee: Atlantic Richfield Company, Los Angeles, Calif.

[21] Appl. No.: 171,709

[22] Filed: Mar. 22, 1988

[51] Int. Cl.[4] ..... E21B 43/02

[52] U.S. Cl. ..... 166/278; 166/369

[58] Field of Search ..... 166/278, 276, 51, 369

[56] References Cited

U.S. PATENT DOCUMENTS

| | | | |
|---|---|---|---|
| 3,007,522 | 11/1961 | Clausse | 166/278 |
| 3,664,421 | 5/1972 | Urbanosky | 166/278 |
| 3,675,717 | 7/1972 | Goins, Jr. et al. | 166/278 |
| 4,353,419 | 10/1982 | Widmyer | 166/278 X |

*Primary Examiner*—Bruce M. Kisliuk

*Attorney, Agent, or Firm*—Michael E. Martin

[57] ABSTRACT

Unconsolidated formations may be produced to yield hydrocarbons and other fluids by forming an openhole wellbore in the region to be produced, cleaning the wellbore face with a low solids content, low leakoff type fluid and/or underreaming the wellbore to provide a clean face in the region of interest and followed by insertion of a production tubing string including a filter medium which will retain larger formation sand particles in the wellbore cavity but will allow a limited amount of solids fines to be produced with the produced fluids. An in situ sand pack is formed within the wellbore cavity together with a dilatant zone of generally cylindrical shape having an outer radius which grows into the formation until the in situ stresses increase and the dilatant zone as well as the in situ sand pack become stable. This type of well completion eliminates the requirement for other means of consolidating formation sands as well as the cost of installing artificial gravel packs in a well.

6 Claims, 1 Drawing Sheet

METHOD FOR COMPLETING WELLS IN UNCONSOLIDATED FORMATIONS

BACKGROUND OF THE INVENTION

1. Field of the Invention

The present invention pertains to a method for completing and producing wells in unconsolidated formations by developing an in situ sand pack of the relatively coarse formation sand particles in a dilatant zone of mechanically stable formation material extending outward from the wellbore.

2. Background

The completion and production of hydrocarbon fluids such as crude oil from relatively unconsolidated sands is complicated by the tendency to produce two much sand with the produced fluid resulting in the breakdown of equipment, plugging of at least portions of the wellbore and the production tubing string and/or complete collapse of the formation material into the wellbore. Various techniques have been contemplated for stabilizing a formation prior to production of fluids including the injection or substances which stabilize or consolidate the formation material in the vicinity of the wellbore. For various reasons, including the composition of the formation, prior art processes often are not satisfactory and they complicate the wellbore completion process.

However, it has been observed in laboratory studies that, when fluids are produced at relatively high rates into a cavity formed in an unconsolidated formation, a dilatant zone is created around the cavity into which the produced fluid flows without producing a significant amount of sand or fine formation material. Based on this observation and other factors, the present invention has been developed to provide an improved method of completing and producing high productivity wells in substantially unconsolidated sands.

SUMMARY OF THE INVENTION

The present invention provides an improved method for producing hydrocarbon fluids and the like from wells extended into unconsolidated sands and similar weakly consolidated formation materials. The completion and production method includes the development of an in situ "sand pack" type filtration medium utilizing formation material and the development of a dilatant or expanding zone around a wellbore of mechanically stable formation material.

In accordance with one aspect of the present invention, a wellbore is completed into a relatively unconcolidated formation by leaving the wellbore in an open hole configuration, providing a wellbore face which is cleaned of any flow-impeding material, providing a filter or screen structure associated with a production tubing string extending to the region to be produced, and bringing the well into production at a rate which will result in the production of a limited amount of relatively fine solid particles with the produced fluid but will leave a formation structure of course solid particles which are trapped by the filter or screen elemetn to form an in situ sand pack outside the wellbore without plugging the filter or production tubing. The rate of fluid production is gradually increased in a way which forms a dilatant zone of relatively coarse sand which becomes mechanically stable as the zone grows outward through increased stresses acting on the formation structure.

In accordance with another aspect of the present invention, a method of producing fluids from unconsolidated sands includes the steps of cleaning the formation face of the wellbore to promote production of fluids and fine solids by circulation of a low solids content, low leakoff type of fluid prior to commencing fluid production from the formation. In addition to circulation of the low solids - low leakoff fluid the wellbore may be underreamed to increase the cavity size and remove any formation plugging materials, such as drilling fluids, from the formation face.

In accordance with still a further aspect of the present invention, an improved method of producing fluids from an unconsolidated subterranean formation is contemplated wherein through controlled fluid production rates relatively coarse formation particles, such as sand, form an in situ sand pack to prevent the production of too much of the solids fines which are being carried by the formation fluids toward the production tubing.

The abovenoted features and superior aspects of the present invention as well as other advantages thereof will be further appreciated by those skilled in the art upon reading the detailed description which follows in conjunction with the drawing.

DESCRIPTION OF A PREFERRED EMBODIMENT

Figure 1:
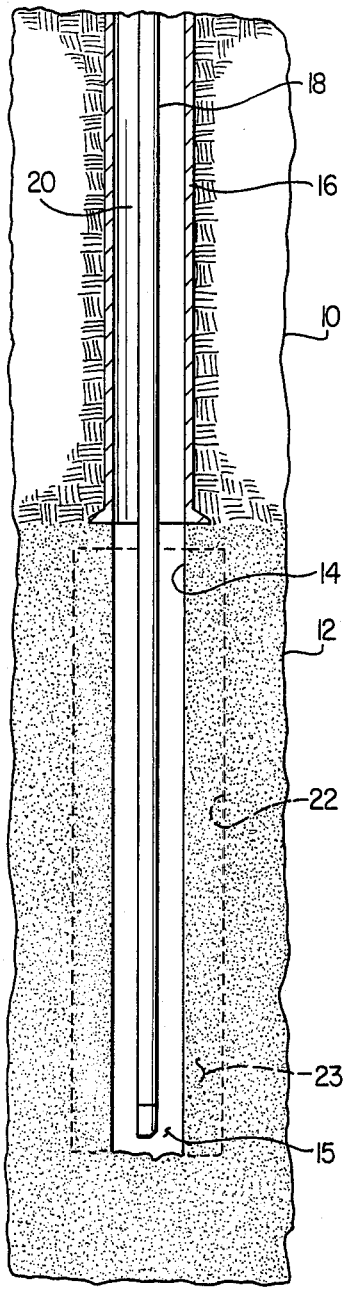
FIG. 1 is a vertical section view in somewhat schematic form of a wellbore completion in an unconsolidated formation in accordance with the present invention.

In the description which follows like features are marked throughout the specification and drawing with the same reference numerals, respectively. The drawings are in somewhat schematic form for the purpose of illustrating the improved method of the present invention.

Referring to FIG. 1, there is illustrated a subterranean earth formation 10 having a region 12 of substantially unconsolidated oilbearing sand. The production of crude oils and other fluids from unconsolidated sandlike formations is usually complicated by the production of said together with the fluids to the extent that frequent clogging of filters or "gravel packs" as well as other portions of the wellbore and associated production equipment is experienced. Various chemical treatments of unconsolidated sands are sometimes attempted in an effort to consolidate the formation structure in the vicinity of the wellbore to prevent collapse of the formation and/or significant production of solids along with the produced fluids. These processes are only partially satisfactory in that the materials injected into the formation tend to reduce the permeability of the formation in the region to be produced, the consolidated region is not uiform due to uneven distributionn of the injected material and the expense of producing fluids from the wellbore may be substantially increased.

In accordance with the improved method of the present invention, it is contemplated that a wellbore may be formed penetrating into the unconsolidated region 12 which includes an uncased or so-called openhole portion 14. The remaining wellbore portion may include a casing 16 extending from conventional surface wellhead structure, not shown. Upon formation of the openhole wellbore portion 14, conventional drilling fluid may be displaced by circulating a relatively low solids content fluid having low leakoff characteristics to clean the wellbore face free of the drilling fluid, the latter normally having permeability or leakage reducing solids included therein. The face cleaning fluid is preferably injected into the wellbore portion 14 through a conventional tubing string 18 into the wellbore annular cavity 15 and circulated up through the wellbore annulus 20 to clean the face of the wellbore portion 14. The face cleaning fluid might contain materials such as starch, certain polymers or other degradable materials which would exhibit low leakoff characteristics but which would not tend to plug the formation itself in the same manner that would likely be done by a conventional drilling mud.

Alternatively or additionally, as indicated by the dashed line 22 in FIG. 1, the wellbore portion 14 may be underreamed to clean the wellbore face, enlarge the surface area of the wellbore face and provide a larger wellbore cavity 23 for producing fluids and coarse sand in accodance with the method of the present invention.

Figure 2:
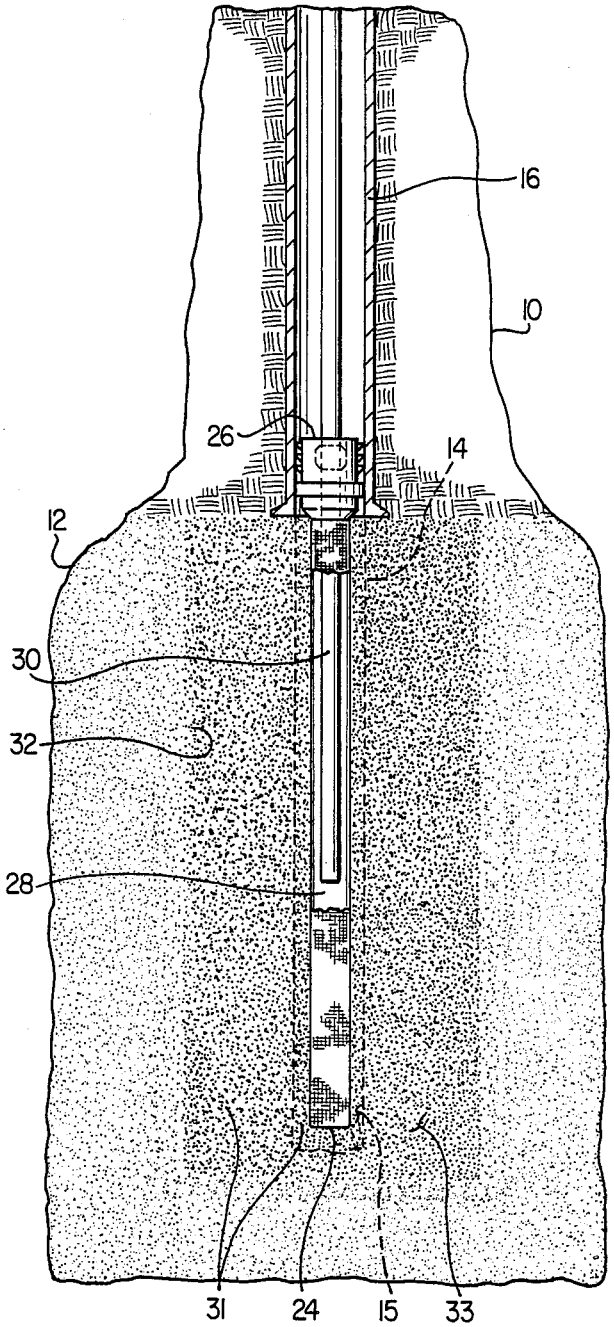
FIG. 2 is a view similar to FIG. 1 showing the growth of the dilatant zone and the formation of the in situ sand pack.

Referring now to FIG. 2, after cleaning the face of the wellbore portion 14 and/or underreaming the wellbore, a suitable generally tubular liner 24 is inserted in the wellbore and hung in a conventional manner by a hanger 26. The liner 24 preferably comprises a filter characterized by a screen or other filtration medium with a pore size which will allow fine solids to be produced from the formation region 12 into an interior space 28 of the liner for production through a tubing string 30. The tubing stringn 30 may include suitable pump means, not shown, for producing crude oil and/or other formation fluids to surface structure, also not shown. The filtering medium provided by the liner 24 is sized to retain only a reasonable fraction of the larger sizes of the formation sand 31 in the formation and in the wellbore cavity portion 15 and/or 23. The production tubing 30 and associated production equipment would be adpated to be tolerant of the limited amount of fine solids to be produced with the formation fluids.

Upon commencing production of fluids from the formation region of interest 12, solids would be produced into the annulus or cavity 15 and/or 23 formed between the liner 24 and the face of the wellbore portion 14, or the enlarged wellbore face 22 if formed, and the larger sizes of solids particles would be prevented from flowing into the space 28 by the liner or filter 24. These larger sand particles would, in effect, form an in situ sand packing in the cavity 15 and/or 23 between its face and the outer surface of the liner 24. Moreover, the "expanded" sand formation which has flowed into the annular area between the liner 24 and the original face of the wellbore portion 14 together with the flow of fine particles would cause the development of a dilatant zone 33 having a porosity as high as 40% to 50% and which grows outward into the formation until the in situ stress is increased and the formation again becomes mechanically stable. The expanded zone 33, having a boundary indicated generally by the numeral 32, allows solids fines to move through the zone to the liner 24 and through the screen of the liner into the space 28 for production along with liquids being produced from the formation region 12. The magnitude of the radius defining the outer boundary 32 of the dilatant zone 31 with respect to the wellbore axisi 17 could, to some extent be determined by the degree of underreaming of the wellbore if such is carried out.

Accordingly, the method of the present invention contemplates that an unconsolidated sandlike formation may be produced by the development of an in situ sand pack formed by the formation particles themselves by gradually increasing the rate of production of a well having a screen or similar filter structure inserted therein and producing fluids together with entrained solids fines by allowing the growth of a zone around the wellbore face of sand of larger particle diameters which becomes mechanically stable and which allows the production of a limited amount of solids fines along with the produced formation fluids. The amount of solids fines produced from such a wellbore is dictated by the particle size distribution, the opening size of the filter medium, the distribution of stresses in the formation prior to commencing production and the original porosity of the unconsolidated formation prior to commencing production.

It will be apparent from the foregoing that an improved method of producing fluids from a wellbore penetrating a region of unconsolidated sand has been developed in accordance with the present invention. Although various substitutions and modifications may be made to the method set forth herein, such will likely be done without departing from the scope and spirit of the appended claims.

What is claimed is:

1. A method for producing fluids from a subterranean formation in a formation region of substantially unconsolidated sandlike particles comprising the steps of:

penetrating said region to form an uncased wellbore cavity extending within said region;

inserting filter means into said cavity, said filter means forming an interior space for gathering fluids from said region for production from said wellbore and said filter means including means for permitting the flow of solids fines into said space with said fluids from said region;

causing fluids to flow into said cavity and through said filter means into said space to be produced from said region at a rate which will cause sand particles in said region to flow into and occupy said cavity to form an in situ packing around said filter means;

producing fluids from said region through said cavity and into said space and having a limited quantity of solids fines entrained therein smaller than the solid particles retained in said cavity; and controlling the rate of production of fluids to form a generally cylindrical dilatant zone extending generally radially outward inn said region from said cavity and which is mechanically stable.

2. The method set forth in claim 1 including the step of:

underreaming said wellbore to enlarge the size of said cavity prior to commencing production of fluids from said cavity.

3. The method set forth in claim 1 including the step of;

circulating a low leakoff fluid through said cavity before commencing production of fluids to clean the face of said cavity.

4. A method for producing fluids from a subterranean formation in a formation region of substantially unconsolidated sandlike particles comprising the steps of:

penetrating said region to form a generally cylindrical uncased wellbore defining a cavity extending within said region;

underreaming said wellbore to enlarge the size of said cavity;

inserting filter means into said cavity, said filter means forming an interior space for gatheringn fluids from said region for production from said wellbore and said filter means including means for permitting the flow of solids fines into said space with said fluids from said region;

causing fluids to flow into said cavity and through said filter means into said space to be produced from said region at a rate which will cause sand particles in said region to flow into and occupy said cavity to form an in situ packing around said filter means; and producing fluids from said region through said cavity and into said space and having a quantity of solids fines entrained therein smaller than the solid particles retained in said cavity, said production being at a rate so as to form a generally cylindrical dilatant zone extending radially outwardly in said region from a longitudnal axis of said cavity which is mechanically stable and is generally devoid of said solids fines.

5. The method set forth in claim 4 including the step of:

producing fluids and solid fines at a rate such as to provide said dilatant zone with a porosity of at least 40% to 50%.

6. The method set forth in claim 4 including the step of:

circulating a low leakoff fluid through said cavity before commencing production of fluids to clean the face of said cavity.

* * * * *